US005090084A

United States Patent [19]

De Guzman

[11] Patent Number: 5,090,084

[45] Date of Patent: Feb. 25, 1992

[54] CLEANING ROLLER FOR SURFACES AND APPARATUS FOR USE THEREWITH

[75] Inventor: Joselito S. De Guzman, Hawthorne, Calif.

[73] Assignee: Cleanline Corporation, Hawthorne, Calif.

[21] Appl. No.: 400,580

[22] Filed: Aug. 30, 1989

[51] Int. Cl.[5] ..... B05C 1/08

[52] U.S. Cl. ..... 15/230.11; 15/25; 15/230.16; 15/230.14; 15/230.18

[58] Field of Search ..... 15/230.11, 230.14, 230.12, 15/230.15, 230.16, 230.18, 230.19, 231, 25, 27

[56] References Cited

U.S. PATENT DOCUMENTS

| | | | |
|---|---|---|---|
| 2,187,585 | 1/1940 | Grigas . | |
| 2,695,417 | 11/1954 | Bathurst . | |
| 2,811,733 | 11/1957 | Sloan . | |
| 2,929,088 | 3/1960 | Wier, Jr. | 15/230.16 |
| 3,001,220 | 9/1961 | Canning et al. | 15/230.11 |
| 3,253,290 | 5/1966 | Powers . | |
| 3,363,276 | 1/1968 | Thomas, Jr. | 15/230.11 |
| 3,378,871 | 4/1968 | Suleski | 15/230.11 |
| 3,448,479 | 6/1969 | Cademartori | 15/230.11 |
| 3,505,699 | 4/1970 | Trumbull | 15/230.11 |
| 3,685,084 | 8/1972 | Bennett | 15/230.11 |
| 3,877,123 | 4/1975 | Pharris | 15/230.11 |
| 4,389,053 | 6/1983 | Innis, Jr. et al. | 277/152 X |
| 4,573,233 | 3/1986 | Stoop | 15/230.11 |
| 4,815,158 | 3/1989 | Crotts | 15/230.16 X |

FOREIGN PATENT DOCUMENTS

| | | | |
|---|---|---|---|
| 2061309 | 6/1972 | Fed. Rep. of Germany | 15/230.11 |
| 2301743 | 7/1973 | Fed. Rep. of Germany | 15/230.11 |
| 3033600 | 4/1982 | Fed. Rep. of Germany | 15/230.11 |
| 45528 | 9/1969 | German Democratic Rep. | 15/230.11 |
| 8001251 | 6/1960 | PCT Int'l Appl. | 15/230.11 |

*Primary Examiner*—Ernest G. Cusick

*Attorney, Agent, or Firm*—Poms, Smith, Lande & Rose

[57] ABSTRACT

A roller for cleaning surfaces includes a handle for holding the roller. A connecting rod is coupled to the handle. A roller cover made at least in part of a material suitable for applying a cleaning solvent to a surface when the roller cover is rolled along the surface is included. A roller frame supports the roller cover and is rotatably mounted to a segment of the connecting rod so that the roller frame can rotate about the section of the connecting rod. A seal is provided for substantially sealing between the roller cover and the roller frame so that passage of fluid to the inside of the roller cover is substantially prevented so that passage of particles from the inside of the roller cover is substantially prevented. A catch is provided between the roller frame and the section of the connecting rod and interior to the roller cover for allowing rotation of the roller frame in one direction only.

20 Claims, 9 Drawing Sheets

CLEANING ROLLER FOR SURFACES AND APPARATUS FOR USE THEREWITH

BACKGROUND OF THE INVENTION

1. Field of the Invention

The present invention relates to cleaning tools for surfaces and associated equipment, and more specifically to rollers for cleaning surfaces.

2. Related Art

Rollers have been used for cleaning surfaces such as ceilings and walls. With one type of roller, the roller cylinder is allowed to rotate in only one direction through action of a ratchet and pawl. The ratchet and pawl are external to the roller cylinder, which is not suitable for situations where contaminants cannot be tolerated such as in nuclear facilities, hospitals and other health facilities, semiconductor and electronics facilities and in other clean rooms. Solvents or cleaning solutions may affect the operation of the ratchet and pawl and may produce particulates which contaminate the surface being cleaned. Additionally, the ratchet and pawl may be too difficult to operate because there may not be sufficient freedom of rolling in a given direction. Rotating roller mops generally are also known.

Pads, mops and cloth wipes have been used to clean surfaces but the manner of using these does not provide a sufficiently clean surface. For example, mops wipe the surface back and forth, picking up contaminants but also spreading contaminants across the surfaces. It has been recognized previously that wiping in only one direction is preferred but such cleaning motion is not always achieved when using simple pads, mops or cloths.

There is a need for a unidirectional cleaning roller which can lay down solvent or cleaning solution by rolling a roller cylinder on a surface and then locking the roller cylinder to allow wiping of the surface in the other direction using a lock protected from solvent or cleaning solution and covered to prevent escape of particulates. Such a unidirectional roller protects the surface being cleaned from possible creation of particle contaminants by the unidirectional mechanism and wiping in multiple directions is not done. Additionally, the unidirectional mechanism is protected from deterioration or fouling from the solvent or cleaning solution.

SUMMARY OF THE INVENTION

In accordance with the invention, a unidirectional roller includes a mechanism for controlling rotation of the roller cylinder and which is located interior to the roller cylinder. The roller minimizes the possibility of cleaning solution entering the interior of the roller cylinder and of particulate matter or lubricant from moving from the inside of the roller cylinder into the solvent or onto the surface being cleaned. Such a roller for cleaning surfaces includes a handle for holding the roller. A roller frame for supporting a roller cover is rotatably mounted to a segment of the handle so that the roller frame can rotate about the segment of the handle. Means are provided for substantially sealing between a roller cover to be mounted on the frame and the roller frame so that passage of fluid to the inside of the roller cover when a roller cover is in place is substantially prevented. Means are also provided interior to the roller cover when the roller cover is in place for allowing rotation of the roller frame in one direction only.

In one disclosed embodiment, the means for allowing rotation of the roller frame in one direction only includes a spring biased pin depressible by a portion of the roller frame for allowing rotation of the roller frame in the direction of the depression of the pin. Rotation in the opposition direction is prevented by contact of the roller frame with the pin in such a manner that does not depress the pin. Such a design allows for easy rotation of the roller in the one direction but easily prevents rotation in the opposite direction.

In a further embodiment, the means for substantially sealing between the roller cover and the roller frame comprises a chevron seal between the roller frame and the segment of the handle. This minimizes the possibility, under normal operating conditions, of cleaning solution entering the inside of the roller cylinder to contaminate the mechanism and also minimizes the possibility of contaminants such as metal or plastic particulates or lubricants from moving out of the interior of the roller cylinder.

The roller cover may include a plastic lining serving with the seal as a fluid barrier between the fabric or cover material and the interior of the roller cylinder. Alternatively, the roller cover may be a rubberized material which facilitates picking up individual sheets of moistened plain paper or cloth wipes for wrapping around the rubber roller for cleaning a surface. The roller cover material may also be an adhesive-coated rubber material for picking up individual dry sheets of plastic-backed, perforated wiping material. As further alternatives, the roller cover may be a concave-shaped roller cover for conforming to the curvature of pipes, a brush, an open or closed cell foam or absorbent material having a uniform, continuous surface, or one which may be slotted circumferentially about the roller, slotted lengthwise, or slotted both circumferentially and lengthwise to form a diced or cubed foamed configuration. The roller cover material also may have a knobbed surface or may have soft, flexible filaments softer than brush bristles. Furthermore, in the case of a longitudinally slotted, foam roller cover material, rubber blades may be included in the longitudinal slots co-extensive with the length of the foam sections to more effectively clean surfaces. A synthetic chamois or cloth material can also be placed over the foam or absorbent material.

In using a roller according to the present invention, the roller is dipped in a cleaning solution, excess solution being removed by placing the roller cylinder in a wringer or squeezing cylinder, and applied to a surface according to the correct orientation so that movement of the roller in a forward direction allows the roller cylinder to rotate, thereby laying down the cleaning solution. At the end of the forward motion, the direction of roller movement is reversed, locking the roller cylinder relative to the handle so that the roller cover material wipes the surface clean. No rotational or back and forth wiping is done and therefore contaminants on the surface are not moved back and forth and spread around as is the case when a rotational wiping action is used.

For removing contaminants from the roller, the roller may be dipped in the cleaning solution and passed across a perforated panel or wash board to dislodge contaminants from the roller. Additional solvent may then be added to the roller by immersing it further in the cleaning solution, excess solution being removed by placing a roller in a squeezing cylinder or wringer. The wringer may be in form of rigid half cylinders hinged along a common edge, or in the form of a perforated flexible sheet operated by a handle linked to the sheet much like an oil filter wrench tightens around a cylinder.

These and other benefits of the invention will be described in further detail in consideration with the following description of the drawings and the Detailed Description.

DETAILED DESCRIPTION OF THE PREFERRED EMBODIMENTS

Figure 1:
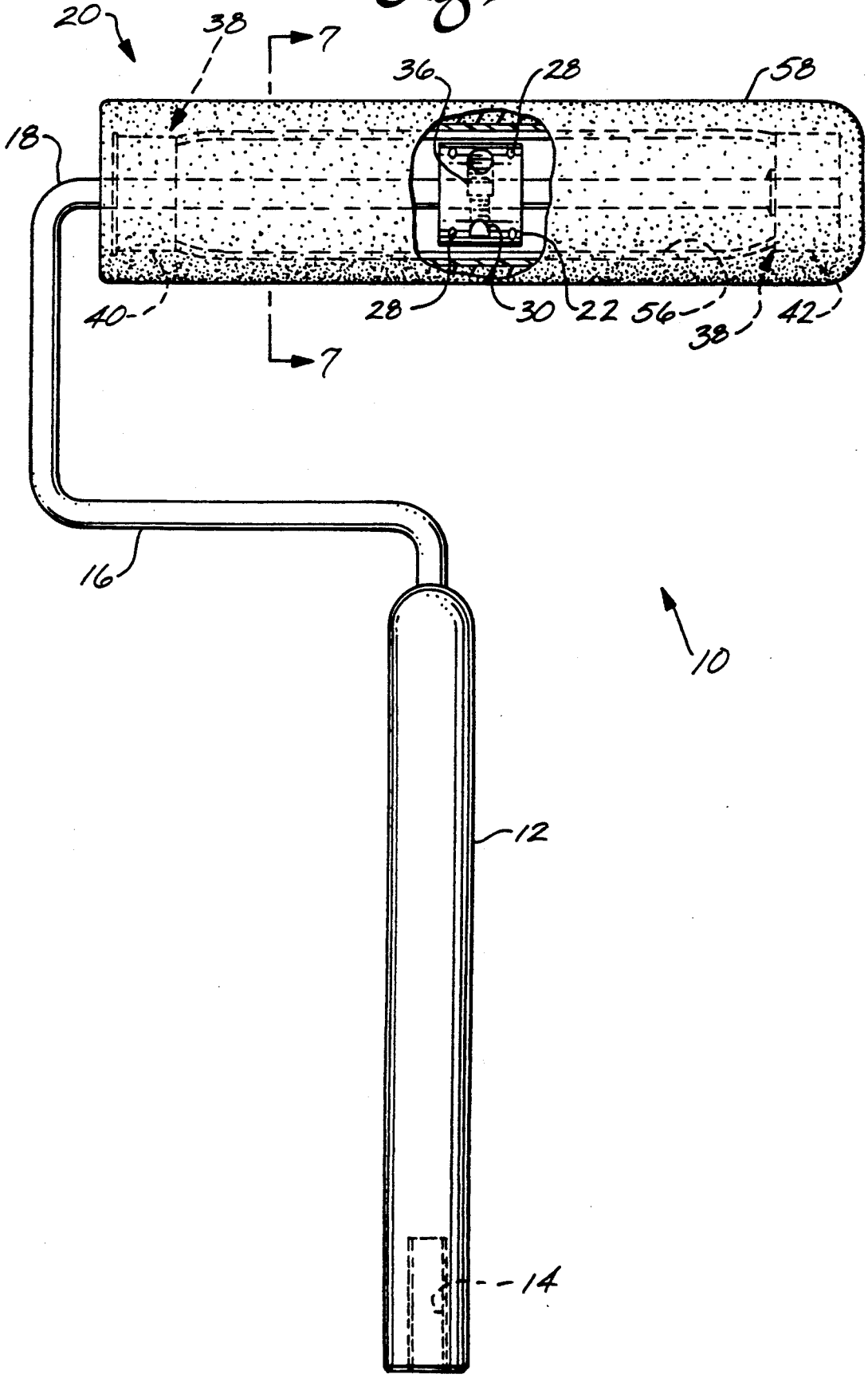
FIG. 1 is a bottom plan and partial cutaway view of a unidirectional roller according to the present invention.

In accordance with the present invention, an improved cleaning tool is provided in the form of a unidirectional roller which lays down a cleaning solution on a surface to be cleaned in one direction and wipes contaminants from the cleaning surface in a second direction when the roller is prevented from rotating. The mechanism in the roller for allowing rotation in only one direction is interior to the roller cover and thereby protected from damage by the cleaning solution. Lubricants or particulate matter from the interior of the roller cover is prevented by a seal from moving to the outside under normal operating conditions.

The roller 10 includes a handle 12 having an internally threaded bore 14 at one end for accepting a complementary threaded extension handle (not shown). Other means may be used for coupling extension handles to the roller. One end of a connecting rod 16 is coupled to the forward end of the handle and extends forward and to the side of the handle to a transversely extending segment or shaft 18 on which is rotatably mounted a roller cylinder 20. The connecting rod is substantially in the shape of a "U" so that the shaft 18 extends transverse to the longitudinal axis of the handle. The shaft 18 and the handle 12 are substantially co-planar in the preferred embodiment.

A rotation limit block or lock 22 limits rotation of the roller cylinder 20 to one direction only. The lock is preferably located interior to the roller cylinder so as to protect it as much as possible from cleaning solvents and the like, and to minimize the possibility of particulates, which may be produced through sliding contact on internal surfaces, from getting outside the roller cylinder and contaminating surrounding surfaces. The lock 22 is mounted to the shaft 18 and is fixed thereto so that the roller cylinder rotates relative to the lock 22. The lock is mounted to the center of the shaft 18 and is formed from two half-cylinders 24 and 26 fastened together around the shaft through appropriate means such as bolts 28. Alternatively, the lock may have a unitary or single-piece body passed over and fixed to the center of the shaft 18 by a set or lock screw inserted into a groove in the shaft, for example.

A spring biased, depressible pin 30 (FIGS. 1 and 7) is slidingly mounted in a bore formed in the half-cylinder 24 (or on the single-piece body) along a chord of the cylinder. The pin extends from the bore beyond the perimeter of the cylinder to prevent rotation of the roller cylinder in one direction while allowing rotation in the opposite direction by forcing the pin to depress inward when the roller cylinder rotates in the opposite direction. The depressible pin 30 includes an outwardly extending rim 32 (FIG. 7) for contacting a shoulder in the bore to capture the pin in the bore and to prevent further movement of the pin outward of the half-cylinder. The pin is biased outwardly by a coil spring 34 held in place by a bolt 36 threaded into the end of the bore opposite the depressible pin. The pin and spring may be lubricated with a suitable light oil to prevent binding of the pin or spring.

Figure 2:
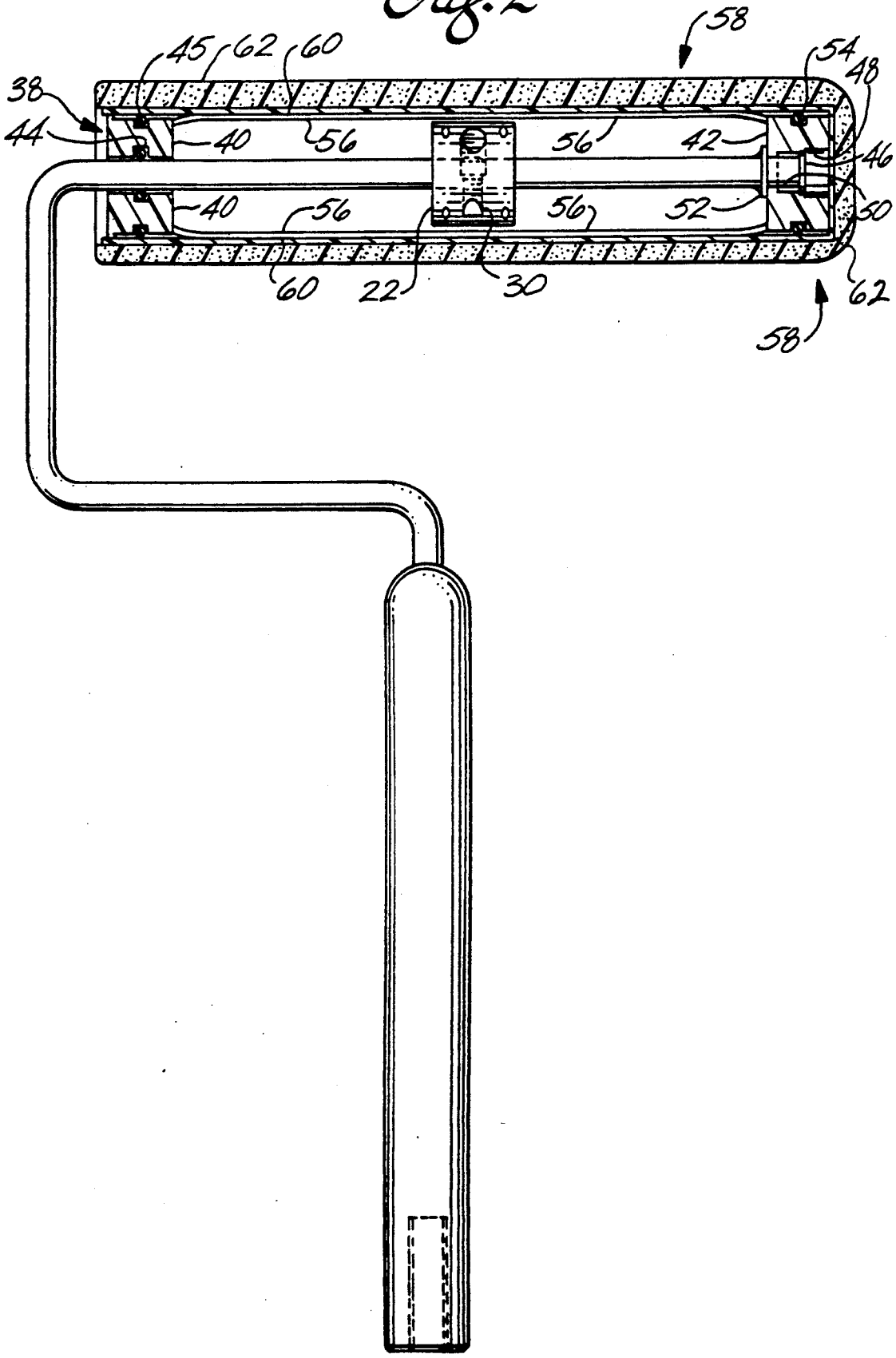
FIG. 2 is a bottom plan of a partial section of the roller of FIG. 1 showing a roller frame and roller cover.

The roller cylinder 24 preferably includes a roller frame 38 including left and right hubs 40 and 42, respectively, for rotating about the circumferential surface of the shaft 18. The left hub 40 includes an internal groove formed in the bore in the hub through which the shaft 18 passes (FIG. 2). A seal 44, such as a chevron seal or an O-ring seal, forms a seal between the internal bore of the left hub and the shaft 18 to prevent liquids such as solvents and contaminants from entering the interior of the roller cylinder along the shaft 18. The seal also minimizes the possibility of contaminants which may be produced through frictional sliding of various surfaces internal to the roller cylinder from getting outside the roller cylinder. A groove is formed in the outer circumference of the left hub 40 for supporting a second seal 45, such as a chevron seal or O-ring seal, to prevent liquids such as solvents or other materials passing inside the roller cylinder. The seal is formed between the outer surface of the left hub 40 and the inside surface of the roller cover, described more fully below.

The right hub 42 is rotatably mounted about the end of the shaft 18. The end of the shaft 18 includes a flange 46 to form a widened end to rest against a shoulder defined by a counter-bore 48 in the bore 50 through which the end of the shaft 18 passes. The flange may be formed on the end of the shaft after the left and right hubs are installed on the shaft 18. A washer 52 is fixed to the shaft 18 on the left side of the right hub to hold the hub in place and prevent movement longitudinally in one direction along the shaft while the flange 46 prevents movement in the other direction.

The outer circumferential surface of the right hub includes a channel or groove for accommodating a seal 54, such as a chevron seal or an O-ring, which serves the same function as the seals 44 and 45 described above with respect to the left hub.

Figure 7:
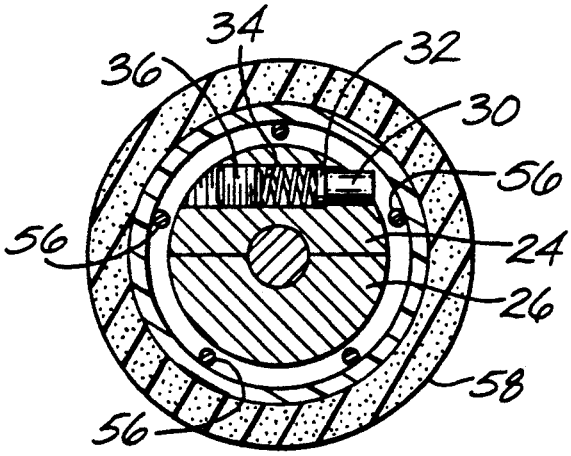
FIG. 7 is a transverse cross section view of the roller cylinder of FIG. 1.

The left and right hubs are coupled to one another and held spaced apart by a number of spokes 56. The spokes provide the mechanism for engaging the depressible pin on the lock 22 for allowing rotation of the roller cylinder in only one direction and also form a support structure for the roller cover, described more fully below. The interaction of the spokes with the lock 22 can be considered most clearly in conjunction with FIG. 7. As the roller is pushed forward, the roller cylinder rotates in the counter-clockwise direction as seen in FIG. 7 so that the spokes contact the face of the depressible pin and push it against the bias of the spring 34. As the counter-clockwise rotation continues, the spoke passes over the face of the pin and beyond, allowing rotation of the roller cylinder to continue and the pin to return to its original position. Rotation continues as long as the roller is moved over the surface, each spoke in turn depressing and passing over the pin 30.

When the roller is pulled back in the opposite direction, the roller cover will rotate a limited amount, in the clockwise direction when viewing the roller in the direction of FIG. 7, until a spoke 56 contacts the side surface of the pin 30. The position of the pin blocks further rotation of the roller, thereby allowing the user to wipe the surface clean.

The roller cylinder includes a roller cover 58 (FIGS. 2, 7) which has a cylindrically shaped plastic lining 60 which is fluid sealed except for the opening at the left end of the roller cylinder The inside diameter of the lining 60 is preferably such as to form a good seal with the seals 44, 45 and 54 to prevent fluid from passing into the interior of the roller cylinder and to minimize the possibility of contaminants going outside of the roller cylinder. Additionally, the spokes define a circle whose diameter is approximately the same as the inside diameter of the lining so that the spokes can support and frictionally engage the roller cover.

The lining is covered with a cleaning material 62 which may be formed from any suitable material for absorbing solvent and wiping surfaces clean. For example, the cleaning material may be a suitable closed or open cell foam, lambs wool, or may be a combination material such as a foam pad and a chamois cover, for example. In a variation, the cleaning material may be a foam material for cleaning more common surfaces, and a chamois or other type of sock can be placed over the foam material for cleaning special surfaces In the preferred embodiment, the roller cover is closed at one end by the lining and covered at that end with the cleaning material so that the end can be used to clean areas which are not easily accessible. Additionally, the corners at the closed end may be rounded.

Figure 3:
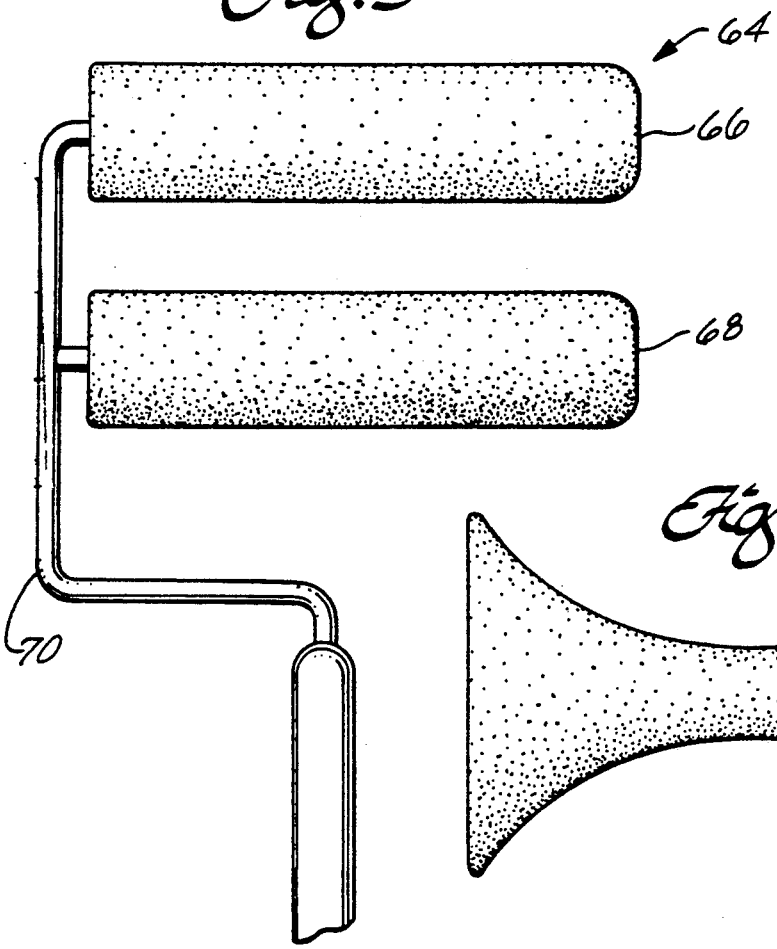
FIG. 3 is a plan view of a further embodiment of a unidirectional roller having a pair of unidirectional roller cylinders for rotation in mutually opposite directions.

With the described unidirectional roller, various roller designs can be derived for cleaning surfaces other than flat surfaces such as countertops and the like. For example, a roller 64 (FIG. 3) may have a pair of parallel disposed roller cylinders 66 and 68 for cleaning the top and bottom surfaces of a counter, railing and the like. The roller cylinders freely rotate in mutually opposite directions. The second roller cylinder 68 may be coupled to a connecting rod 70 in a manner so as to make the spacing between the two rollers adjustable. For example, the shaft for the second roller 68 may be fixed in a channel in the connecting rod so as to allow the second roller cylinder to adjust the connecting rod up and down. A suitable fastener may be used to fix the second cylinder in the desired position.

Figure 4:
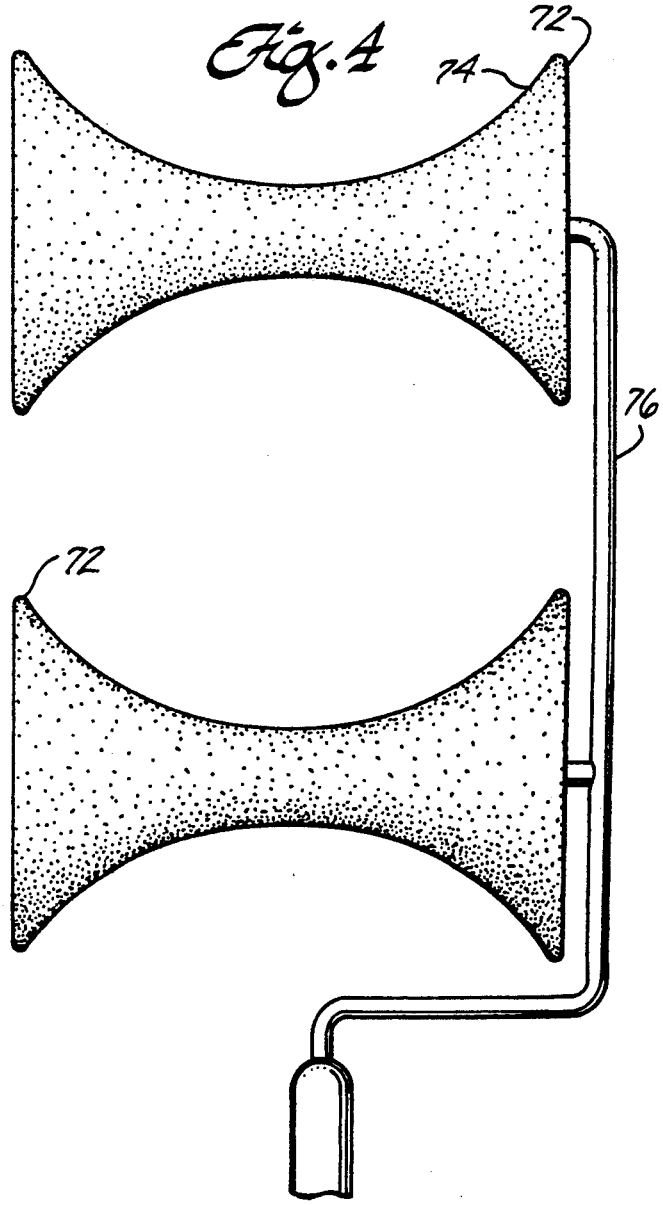
FIG. 4 is a plan view of a further embodiment of the present invention showing a pair of unidirectional roller cylinders with roller covers shaped so as to conform to the outside curvature of a pipe.

Rollers may be formed in selected shapes to also accommodate different surface areas. For example, a roller 72 (FIG. 4) may include concave surfaces 74. A pair of concave roller cylinders may be oriented on a connecting rod 76 in a manner similar to that described with respect to FIG. 3 so as to allow the roller 72 to clean the outside surface of a pipe. It should be understood that the rollers will freely rotate in opposite directions relative to one another.

In operation, the roller 10 (FIG. 1) is wetted with the desired amount of solvent, in a manner to be described more fully below by way of example, and placed on a surface in an orientation to allow the roller to roll when moved in a forward direction. Movement of the roller in the forward direction causes the roller cylinder to roll about the shaft 18, the spokes sequentially depressing the depressible pin to allow the roller cylinder to rotate. Rotation of the roller cylinder applies solvent to the surface to be cleaned. At the end of the forward stroke, when the end of the surface has been reached, the roller is pulled backward in a backward stroke to wipe the surface clean. In this direction, a spoke contacts the side surface of the pin, thereby locking the roller frame and cover from rotation. The surface is wiped clean in a single stroke without back and forth or circular wiping motion.

With the enclosed limit mechanism, any lubricant or any particles which may be produced in the mechanism through friction is prevented from getting outside the roller cover to contaminate any surfaces. Additionally, the seals on the roller also prevent solvent from getting inside the roller cover under normal operating conditions. However, the roller cover is removable from the frame 38, and may then be discarded and a new one added.

The particular design of the lock 22 makes it easy to rotate the roller cylinder using ordinary pressure and motion. Additionally, no lever or other mechanism is necessary to actuate or engage the lock to prevent rotation of the roller.

Figure 5:
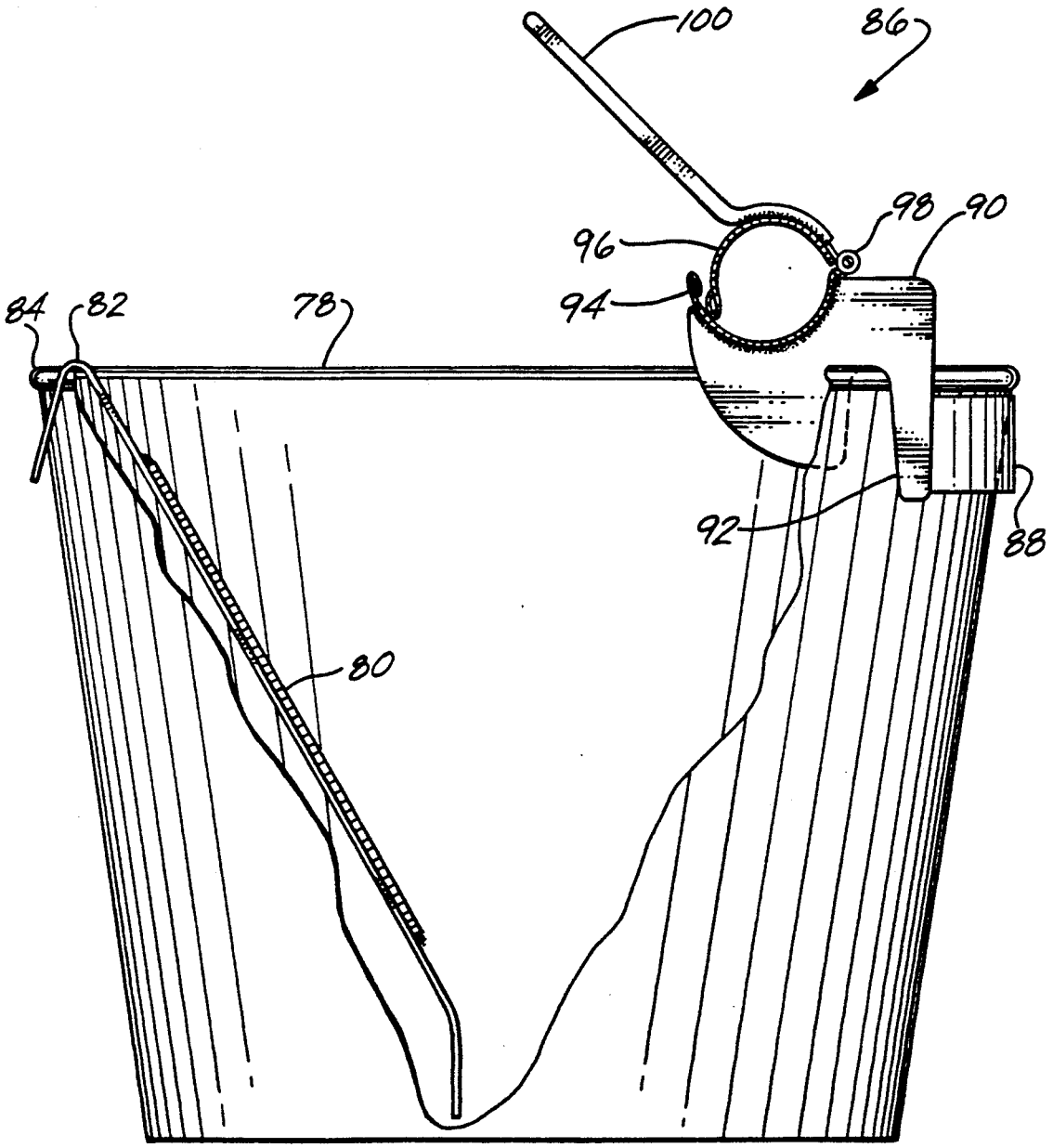
FIG. 5 is a side elevation and partial cutaway view of a cleaning solution basin, roller wringer and wash board for use with a roller according to the present invention.
Figure 6:
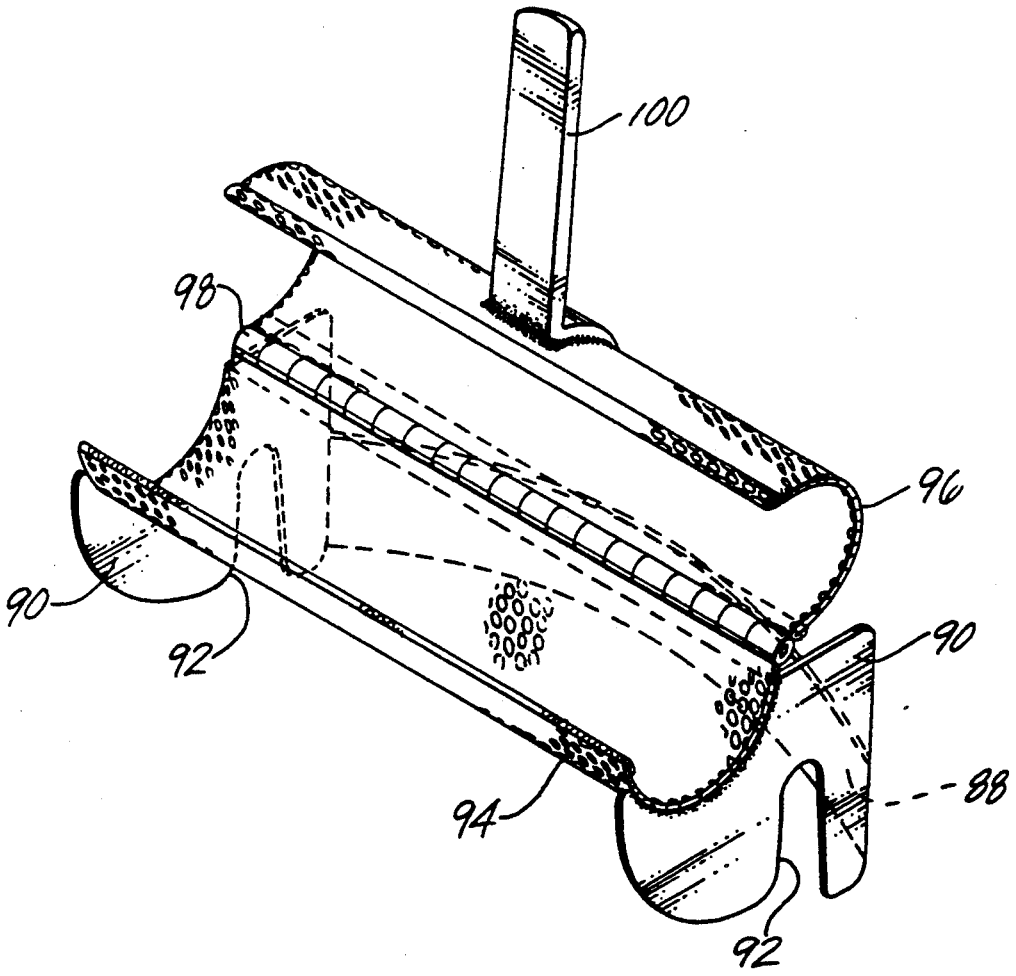
FIG. 6 is a perspective view of the wringer of FIG. 5.

A basin 78 (FIG. 5) may be used to immerse the roller and apply solvent. The basin may include a planar member in the form of a wash board or perforated plate 80 having an uneven surface hanging into the inside of the basin from hooks 82 passing over the rim 84 of the basin. The surface of the plate 80 may be used to dislodge contaminants or abrade the surface of the roller cover. In an alternative embodiment, the plate 80 may include a curved bottom edge to conform to the shape of the roller cylinder when the roller is moved to the bottom of the plate. The curved portion helps to reuse the roller cover. The basin also includes a wringer 86 for wringing solvent from the roller cover. The wringer rests on the rim of the basin and is stabilized by an arcuate band 88 extending between a pair of frames 90, each having cuts 92 formed in the lower portions of the frame into which the rim of the basin is inserted. The frame supports a lower semi-cylindrical perforated screen 94 which is preferably relatively rigid to support the roller cylinder when cradled therein. A substantially cylindrical perforated cover 96 is hinged by a piano hinge 98 to one longitudinally extending edge of the first screen 94. The radius of curvature of the cover is preferably slightly less than the radius of curvature of the screen 94 so that the roller cylinder can be squeezed between the cover and the screen by application of pressure on a handle 100. In a preferred embodiment, the wringer rests below the edge of the basin so that excess solution from the roller stays in the basin.

When using the basin, suitable solvent is put in the basin so that the roller cover can be immersed in the solvent. The plate 80 is used to abrade the surface of the roller cover and the excess solvent is wrung from the roller cover using the wringer 86. The roller is used to clean the surface, as described above, and then reimmersed in the solvent. The contaminated solvent is then wrung from the roller using the wringer 86. The roller is then again immersed in the solvent and the process repeated a suitable number of times and then the roller is reused to further clean the surface. The plate 80 may be used as necessary to help remove contaminates and to abrade the surface of the roller cover.

Figure 8:
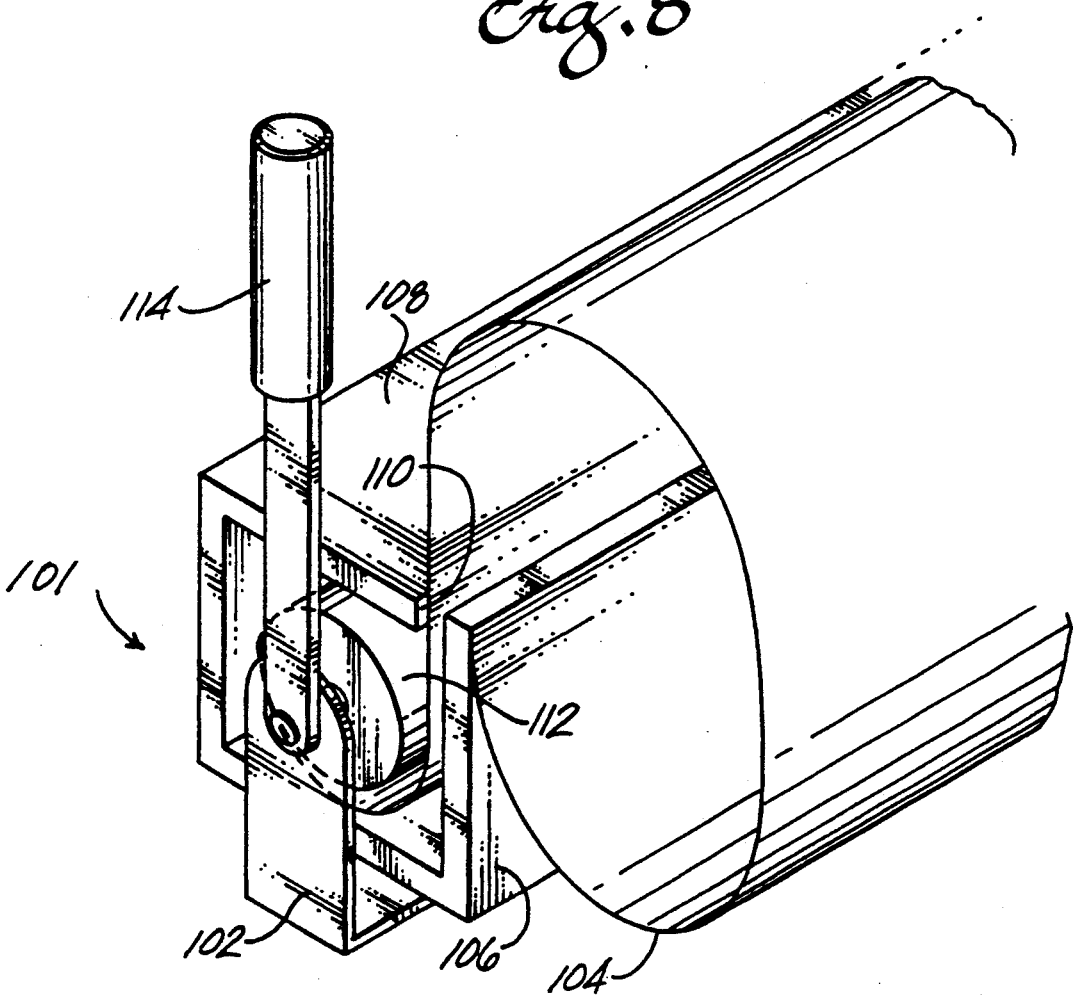
FIG. 8 is a perspective view of an alternative embodiment of a wringer for use with the basin of FIG. 5.

An alternative wringer 101 (FIG. 8) may be used with the basin. The wringer includes mounting brackets 102 for mounting the wringer on the rim or other portion of the basin. The wringer 101 includes a relatively flexible, perforated sheet 104 mounted to a longitudinally extending frame 106 for supporting one end of the sheet 104. The sheet is fixed along the entire length of the sheet to the frame 106 as would be known to one skilled in the art. The wringer further includes a cover 108 with a slotted opening 110 through which the sheet 104 is passed. The other end of the sheet is wrapped around and fixed to a cylinder 112 rotatably mounted to the frame 102. A handle 114 is used to rotate the cylinder 112 to take up the flexible sheet 104 to thereby decrease the amount of space in the interior of the rolled sheet. The roller is wrung out by placing the roller cylinder inside the curved sheet and turning the handle 114 to wrap the sheet around the roller cover. As the handle is turned further, pressure is applied to the sheet to wring out the excess solvent from the roller cover.

Figure 9:
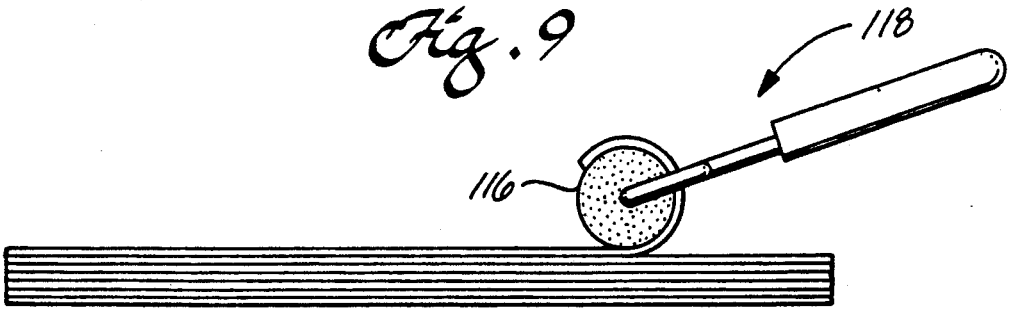
FIG. 9 is a side elevation view of a roller and sheets of wipe material according to a further embodiment of the present invention.

In an alternative embodiment of the roller cylinder, the roller cover may be formed from a moderately hard rubber material, i.e. one having a tacky surface, or other suitable material having a rubberized covering over the plastic core. A roller 118 (FIG. 9) includes the rubber cover 116 which can be used to pick up moistened paper or cloth sheets of cleaning material as the rubber surface is rolled over a sheet. The moistened sheet adheres to the outside surface of the roller cover and the roller cover is wrapped around the rubber roller cover. The sheets may be moistened with a suitable solvent so that the sheets can then be used to clean the desired surfaces. When a particular sheet is soiled, the sheet may be discarded or cleaned and reused. Alternatively, an adhesive may be applied to the roller cover so that it can pick up dry sheets for cleaning or wiping surfaces.

Figure 10:
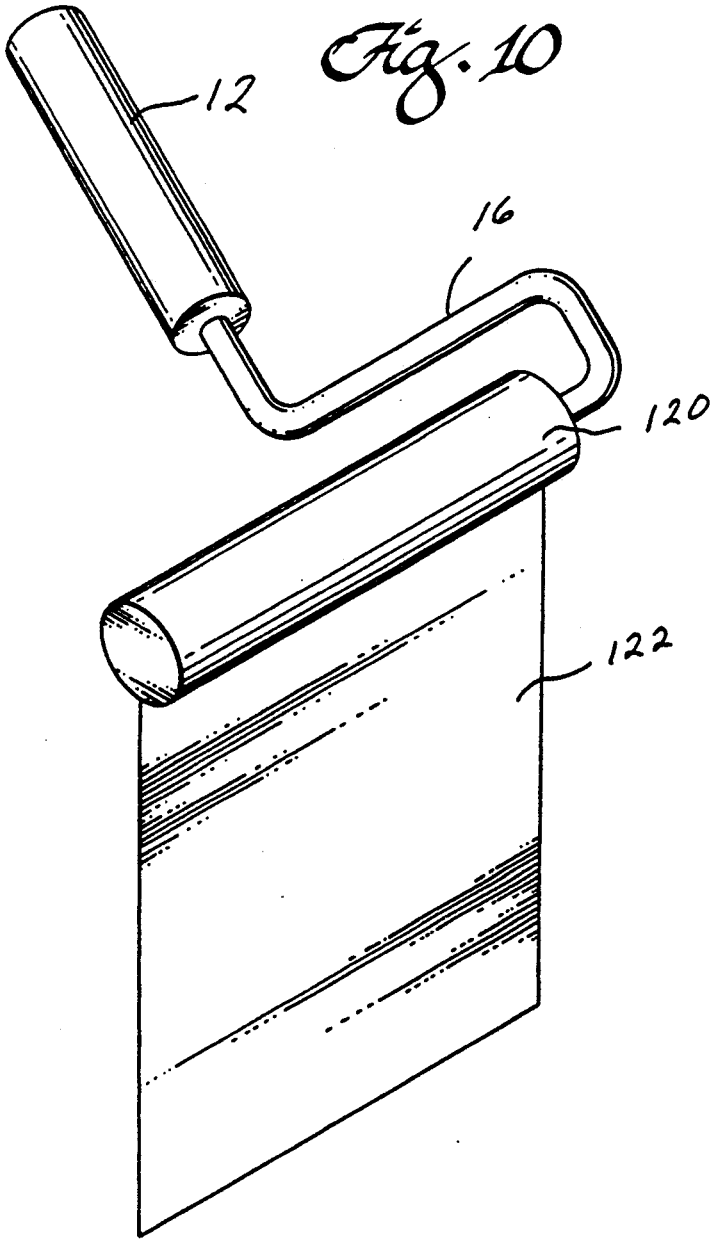
FIG. 10 is a perspective view of a further embodiment of a roller according to the present invention having a roller cover and a cleaning sheet attached at one end to the roller cover.

In an alternative embodiment of the roller of the present invention, the roller cover may include a foam pad 120 and a cleaning sheet 122 having one end fixed to the roller cylinder (FIG. 10). The cleaning sheet may be immersed in a solvent and wrapped around the roller cylinder and then be used to clean or wipe surfaces as described above.

Figure 11:
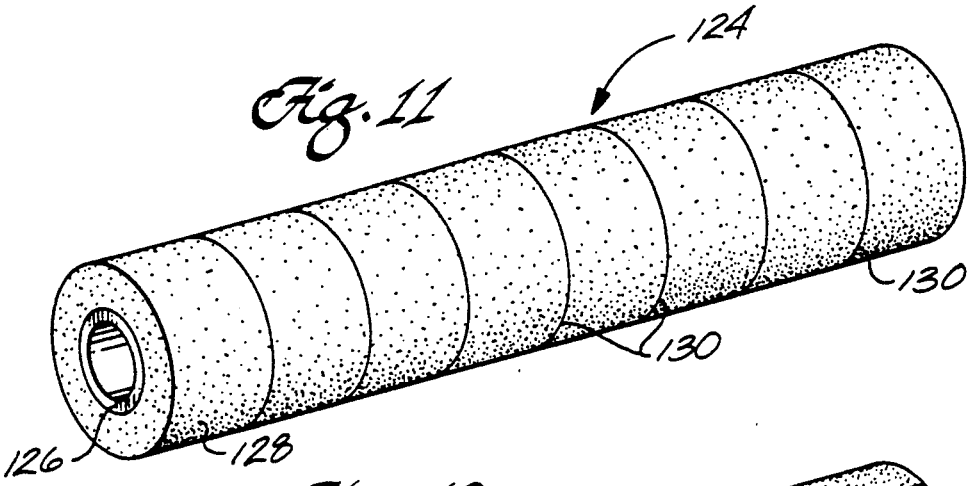
FIG. 11 is a perspective view of one embodiment of a roller cover having circumferential slots in the cover.

In a further embodiment of a roller cover, a cover 124 (FIG. 11) includes a plastic lining 126 and a foam cover 128. The cover includes a plurality of circumferential slots 130 cut or formed in the foam extending radially outward from the lining 126. The slots in the foam enable more efficient cleaning of uneven surfaces.

Figure 12:
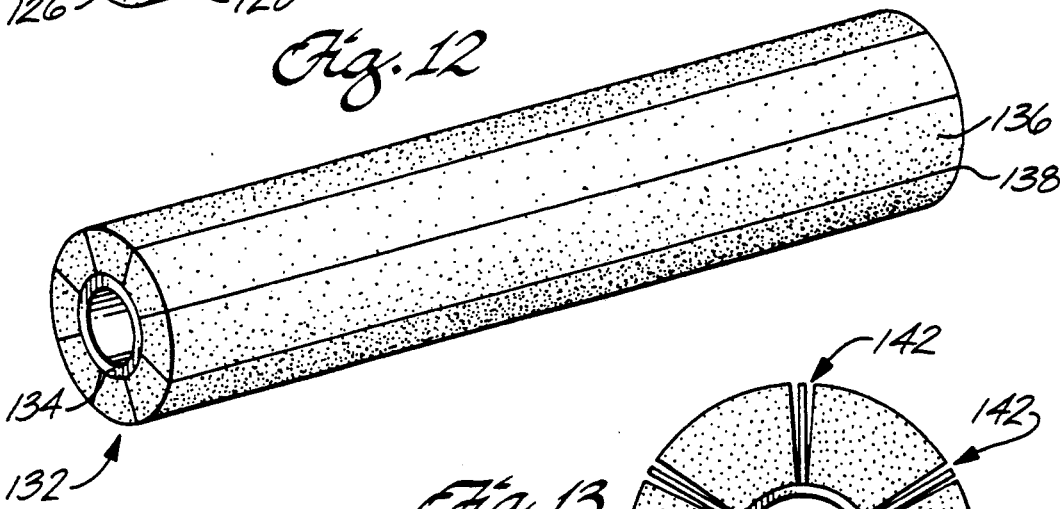
FIG. 12 is a perspective view of a further embodiment of a roller cover having longitudinal slots in the cover.

In a still further embodiment of a roller cover, a roller cover 132 (FIG. 12) includes a lining 134 and a foam cover 136. The cover includes longitudinally extending slots or cuts 138 in the foam. The plurality of slots are distributed circumferentially about the lining 134. The slots enable more efficient cleaning of a flat surface.

Figure 13:
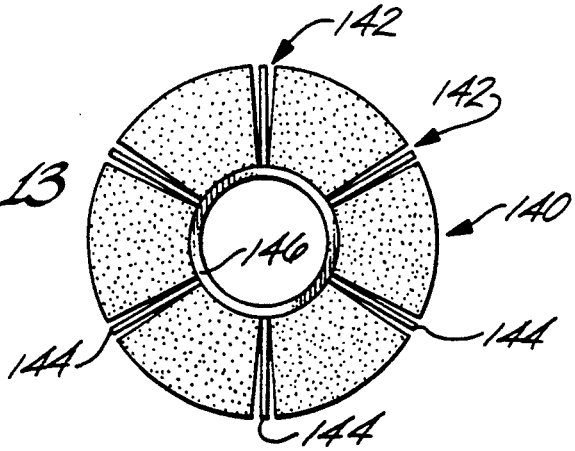
FIG. 13 is a side elevation of a further embodiment of the roller cover of FIG. 12.

In a further embodiment of a roller cylinder according to the present invention, a roller cover 140 includes longitudinally extending slots 142 such as those described above with respect to FIG. 12. Corresponding to each slot, a plastic or rubber sheet 144 (FIG. 13) is disposed in each slot and extends longitudinally the length of the respective slot. Each sheet 144 is fixed to the lining 146 of the roller cover. The plastic sheet between the foam sections assists in cleaning surfaces on a reverse stroke.

Figure 14:
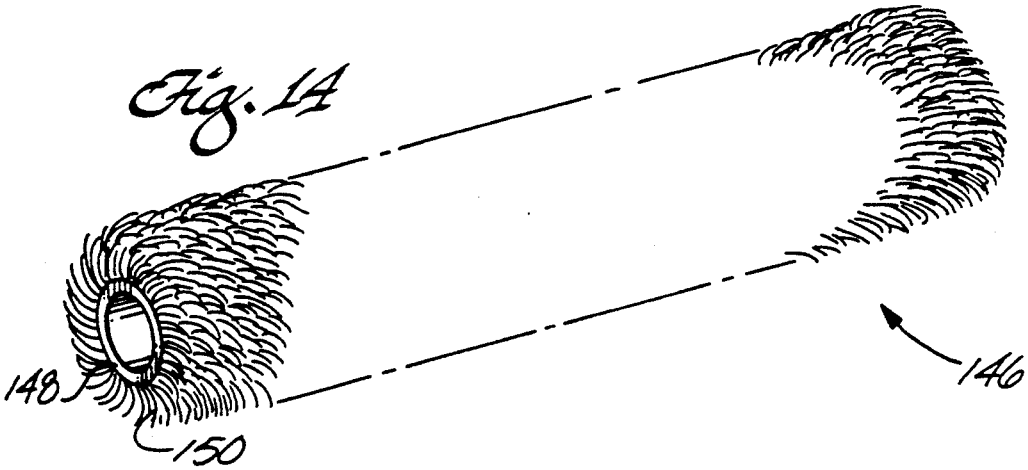
FIG. 14 is a perspective view of a further embodiment of a roller cover having filaments.

FIG. 14 shows a further embodiment of a roller cover 146 according to the present invention. The cover includes a lining 148 to which are fixed a plurality of flexible rubber or plastic filaments 150 for cleaning suitable surfaces.

As a further embodiment of a roller cover, the cover may include a foam material formed or disposed about the lining. The surface of the foam material is uneven, and may include foam knobs, for example, to facilitate cleaning uneven surfaces.

Figure 15:
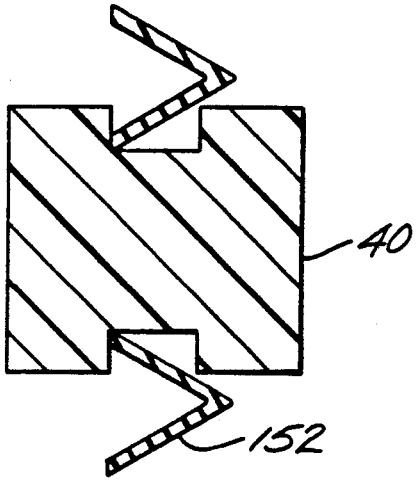
FIG. 15 shows a chevron seal on a hub for use with the roller of FIG. 1.

FIG. 15 shows an example of a chevron seal 152 in a groove on a hub 40, with the point of the seal directed to the inside of the roller cylinder.

As a further embodiment of the roller cover, the seal element such as a chevron seal may be placed in a groove formed in the interior surface of the lining of the roller cover rather than in the roller frame at points along the lining corresponding to the locations of the seals discussed above with respect to FIG. 2. The groove may be a dove-tail groove for retaining the seal.

Another handle may be mounted to the handle 12 and which has a pivot and locking mechanism allowing for the roller 10 to fixed at an angle relative to the rest of the roller. The angled handle allows a technician to clean high surfaces such as cabinet tops while still standing on the floor.

With the present unidirectional roller, surfaces can be cleaned in a more efficient and reliable manner without circular or back and forth wiping. The unidirectional roller includes a mechanism internal to the roller cover so that solvent does not foul or contaminate the mechanism and so that particulates cannot get outside the roller cover. The roller cover may take various forms to accommodate different surfaces, and a given roller cover may also accept a sock cover of a different material.

The described embodiment of the invention is only considered to be preferred and illustrative of the invention concept; the scope of the invention is not to be restricted to such embodiment. Various and other numerous arrangements may be devised by one skilled in the art without departing from the spirit and scope of this invention.

I claim:

1. A roller for cleaning surfaces using a roller cover placed on the roller for wiping a surface, the roller comprising:

a handle for holding the roller;

a shaft segment coupled to the handle;

a roller frame for supporting a roller cover when placed on the roller frame and rotatably mounted to the shaft segment so that the roller frame can rotate about the shaft segment wherein the frame defines an interior portion of the frame;

seal means on the roller frame for substantially sealing between a roller cover, when installed on the roller frame, and the roller frame so that passage of the fluid to the interior of the roller frame is substantially prevented; and means interior to the roller frame for allowing rotation of the roller frame in one direction only.

2. The roller of claim 1 wherein the means for allowing rotation of the roller frame in one direction only comprises a a spring and a pin depressible against the bias of the spring by a portion of the roller frame for allowing rotation of the roller frame in the one direction while contact with the pin by the portion of the roller frame in the other direction prevents rotation of the roller frame in the other direction.

3. The roller of claim 2 wherein the means for allowing rotation of the roller frame in one direction only is fixed to the handle between the handle and the roller frame.

4. The roller of claim 2 further comprising a connecting rod having a segment which extends in a first direction, the roller frame includes a plurality of spokes extending at least in part parallel to the segment of the connecting rod and wherein the spring biased pin is mounted to the connecting rod segment such that one of the spokes in the plurality of spokes pushes on an end of the pin when rotating in the one direction and contacts a side of the pin to prevent rotation in the other direction.

5. The roller of claim 1 wherein the means for substantially sealing comprises "O" rings.

6. The roller of claim 1 wherein the means for substantially sealing comprises a chevron seal.

7. The roller of claim 6 wherein the roller frame comprises a hub and the chevron seal extends between the hub and the handle.

8. The roller of claim 7 further comprising a roller cover placed over the roller frame and wherein the hub includes an external surface and further comprises a second chevron seal for sealing between the external surface and the roller cover.

9. The roller of claim 8 further comprising a roller cover over the roller frame which includes a plastic lining for forming a seal with the second chevron seal.

10. The roller of claim 8 wherein the roller cover has one closed end.

11. The roller of claim 1 further comprising a roller cover over the roller frame including a rubber outer cover about which is wrapped wiping material for cleaning surfaces.

12. The roller of claim 1 further comprising a first roller cover placed over the roller frame and wherein the roller comprises a second roller frame, and a second roller cover wherein the first and second roller frame and cover can rotate only in opposite directions relative to each other.

13. The roller of claim 12 wherein the first and second roller covers are concave roller covers.

14. The roller of claim 1 further comprising a foam roller cover over the roller frame.

15. The roller of claim 14 wherein the foam roller cover includes a sheet of wipe material having one end coupled to the roller cover.

16. The roller of claim 14 wherein the foam roller cover includes a plurality of cylindrical sections separated from one another by circular cuts in the foam.

17. The roller of claim 14 wherein the foam roller cover includes a plurality of longitudinally extending arcuate foam sections extending the length of the roller cover.

18. The roller of claim 17 wherein the foam sections of the roller cover define longitudinally extending spaces and wherein the roller cover further includes flexible blades in the longitudinally extending spaces.

19. The roller of claim 17 wherein the roller cover further includes a plurality of flexible filaments.

20. A roller for cleaning surfaces comprising:

a handle for holding the roller;

a shaft segment coupled to the handle;

a roller frame rotatably mounted to the shaft segment of the handle so that the roller frame can rotate about the shaft section wherein the frame defines an interior portion;

a roller cover supported by the roller frame such that the interior portion of the frame is enclosed by the roller cover;

seal means between the roller frame and the roller cover for substantially sealing between the roller cover and the roller frame so that passage of the fluid to the interior of the roller frame is substantially prevented; and means interior to the roller frame for allowing rotation of the roller frame in one direction only.

* * * * *